US005655374A

United States Patent [19]

Santilli et al.

[11] Patent Number: 5,655,374

[45] Date of Patent: Aug. 12, 1997

[54] SURGICAL SUIT

[75] Inventors: Albert N. Santilli, Mayfield Heights; Jeffrey M. Kalman, Cleveland Heights; Richard O. McCarthy, Strongsville, all of Ohio

[73] Assignee: Surgical Specialty Products, Inc., Cleveland, Ohio

[21] Appl. No.: 607,276

[22] Filed: Feb. 21, 1996

[51] Int. Cl.[6] ..... F25B 21/02; F25D 23/12; A41D 13/00

[52] U.S. Cl. ..... 62/3.5; 62/259.3; 2/905; 2/906

[58] Field of Search ..... 62/3.2, 3.5, 3.7, 62/259.3; 607/108, 112; 454/370; 2/1, 2, 7, 202, 209.13, 901, 905, 906, DIG. 1

[56] References Cited

U.S. PATENT DOCUMENTS

| | | |
|---|---|---|
| D. 295,046 | 4/1988 | Odell . |
| 3,075,360 | 1/1963 | Elfving et al. . |
| 3,085,405 | 4/1963 | Frantti . |
| 3,137,142 | 6/1964 | Venema . |
| 3,138,934 | 6/1964 | Roane . |
| 3,283,520 | 11/1966 | Donohue et al. . |
| 3,294,088 | 12/1966 | Boehmer et al. . |
| 3,412,566 | 11/1968 | Townsend et al. . |
| 3,467,965 | 9/1969 | Murphy . |
| 3,488,971 | 1/1970 | Meckler . |
| 3,500,649 | 3/1970 | Feldman . |
| 3,548,415 | 12/1970 | Waters . |
| 3,584,314 | 6/1971 | Hobson . |
| 3,602,001 | 8/1971 | Bauer et al. . |
| 3,635,037 | 1/1972 | Hubert . |
| 3,657,740 | 4/1972 | Cialone . |
| 3,963,021 | 6/1976 | Bancroft . |
| 4,019,508 | 4/1977 | Der Estephanian et al. . |
| 4,227,520 | 10/1980 | Lord . |
| 4,364,234 | 12/1982 | Reed . |
| 4,463,569 | 8/1984 | McLarty . |
| 4,470,263 | 9/1984 | Lehovec et al. . |
| 4,590,951 | 5/1986 | O'Connor . |
| 4,622,822 | 11/1986 | Beitner . |
| 4,730,612 | 3/1988 | Dampney . |
| 4,753,083 | 6/1988 | Sato . |
| 4,890,335 | 1/1990 | Crowson . |
| 4,893,356 | 1/1990 | Waters . |
| 4,971,052 | 11/1990 | Edwards . |
| 5,005,216 | 4/1991 | Blackburn et al. . |
| 5,007,242 | 4/1991 | Nakayama . |
| 5,029,342 | 7/1991 | Stein et al. . |
| 5,040,381 | 8/1991 | Hazen . |
| 5,042,258 | 8/1991 | Sundhar . |
| 5,042,474 | 8/1991 | Williamson . |
| 5,050,240 | 9/1991 | Sayre . |
| 5,193,347 | 3/1993 | Apisdorf . |
| 5,197,294 | 3/1993 | Galvan et al. . |

*Primary Examiner*—William Doerrler
*Attorney, Agent, or Firm*—Rankin, Hill, Lewis & Clark

[57] ABSTRACT

A surgical suit includes a hood fitted loosely about the user's head and a gown fitted loosely about the user's body. The hood has a large visor through which the user can see. A housing is spaced above the user's head and underneath the hood. The housing carries a substantial portion of the weight of the hood. The housing is supported above the user's head by means of vertically extending support rods that are connected to a backpack. A fan is disposed in the housing, as well as an optional thermoelectric module. An exhaust fan is included as part of the backpack. The fan in the housing causes air to be drawn through a filter and then flowed past the user's face. The fan in the backpack causes air to be drawn downwardly from around the user's upper body and exhausted from the gown through a filter.

20 Claims, 5 Drawing Sheets

SURGICAL SUIT

BACKGROUND OF THE INVENTION

1. Field of the Invention

The invention relates to surgical suits and, more particularly, to a surgical suit that provides a high degree of sterility while being comfortable for the wearer.

2. Description of the Prior Art

There are a variety of circumstances where a worker is required to work for extended periods of time in an uncomfortable environment. For example, surgeons and other personnel in operating rooms must spend extended periods of time in an environment that requires the greatest degree of sterility possible while maintaining high levels of ambient light. Although operating rooms usually are air-conditioned, the heat generated by overhead lights causes high temperatures to exist in the region of the lights themselves. Surgeons and other personnel that are required to stand for extended periods of time in proximity to the operating table thus will find that the lower portions of their bodies are comfortable, while the upper portions of their bodies are subjected to intense heat from the operating room lights.

A variety of techniques have been used to attempt to alleviate the discomfort of surgeons and other operating room personnel. One approach that has been tried in areas other than operating room conditions involves providing a helmet with a battery powered or solar powered fan. The fan is arranged relative to the helmet such that a flow of air will be directed downwardly about the face and head of the wearer. A representative example of such a helmet is disclosed in the patent to Waters, U.S. Pat. No. 4,893,356.

Another approach involves providing a protective suit for the worker. A source of pressurized air is connected to the suit by means of a supply hose that enables air to flow between the worker and the inner surfaces of the suit. Such a device is disclosed in the patent to Blackburn, et al., U.S. Pat. No. 5,005,216.

In an effort to increase the comfort of persons who must work in extremely warm environments, an air conditioning capability has been provided for helmets and suits. For example, the patent to Apisdorf, U.S. Pat. No. 5,193,347, the disclosure of which is incorporated herein by reference, discloses a thermoelectric heat pump, also referred to as a thermoelectric module (TEM), included as part of a helmet-attached housing. The TEM is a so-called Peltier device that has a heat abstraction side and a heat dissipation side. Air is flowed past the heat dissipation side by means of a fan and thereafter is directed downwardly past the face of the user to cool the user's face. The patent to Lehovec et al., U.S. Pat. No. 4,470,263, is similar to the patent to Apisdorf in the sense that a device operating on the Peltier principle is used to cool the user. In Lehovec, the Peltier device makes direct contact with the user's skin.

The patents to Frantti, U.S. Pat. No. 3,085,405, and Galvan et al., U.S. Pat. No. 5,197,294, disclose protective body suits having an air conditioning capability. Both Frantti and Galvan et al. disclose the use of Peltier devices to cool the wearer. In Frantti, the Peltier device is attached directly to the back of the suit and air is blown into the suit through several ducts. A similar arrangement is provided by Galvan et al., where the Peltier device, a fan, and ductwork are disposed outside the suit.

A problem not addressed by the foregoing devices is providing an effective technique to cool the wearer in a comfortable manner while maintaining a high degree of sterility. For use in an operating room or other clean room environment, it is desirable that the worker be enclosed as completely as possible by a protective garment, but enclosing a worker in a protective garment makes it difficult to cool the worker, and it also can impair the ability of the worker to perform any necessary work. For example, it is possible that the vision of the worker could be impaired, particularly if a close-fitting hood encloses the head of the wearer. Yet an additional problem that has confronted prior devices is that of tethering, that is, the requirement that the worker be connected by means of electrical cords or air hoses to a fixed location within a room.

Desirably, any effective technique for cooling the wearer while maintaining a high degree of sterility would permit the worker to move about without being tethered. Any such technique also would minimize the discomfort to the wearer associated with heavy, close-fitting devices such as helmets. Also, any effective technique for cooling a worker should permit the maximum degree of flexibility and control so that the user can efficiently perform whatever task is required.

SUMMARY OF THE INVENTION

In response to the foregoing concerns, the present invention provides a new and improved surgical suit that maintains a high degree of sterility while providing a flow of air to cool the worker. The invention can incorporate air-conditioning, or it can provide a flow of uncooled ambient air. In its most basic form, the invention employs a hood fitted loosely about the user's head. The hood includes a large transparent visor disposed in front of the user's face. A gown is fitted loosely about the user's body and is connected to the hood to provide a substantially integral connection.

A housing is spaced above the user's head and underneath the hood. The housing carries a substantial portion of the weight of the hood and visor. The housing is maintained in position above the user's head by a support means connected to the user's torso. The support means includes a shell that is connected to the user by means of a belt and shoulder straps. The shell includes a bracket from which one or more vertically extending support rods extend to the housing. The bracket and rods are adjustable so that the height of the housing above the user's head and the fore-and-aft position of the housing relative to the user's head can be adjusted.

If it is desired to cool the air being provided to the user, a thermoelectric module (TEM) is provided for the housing. The TEM has a heat dissipation side and a heat abstraction side. The heat abstraction side is disposed within an intake duct included as part of the housing. A fan disposed in the intake duct draws ambient air past to the heat abstraction side of the TEM and then causes the air to be discharged downwardly past the user's face. An exhaust fan is included as part of the shell. The exhaust fan draws air downwardly from the hood and the upper regions of the gown for discharge to the atmosphere outside the gown. By providing appropriate filters for the intake duct and the exhaust fan, a closed system is provided. Accordingly, the highest degree of sterility can be maintained, while the user can work in a comfortable environment. Because the housing is not in contact with the user's head, the user is able to function with the least amount of restriction. Because all of the weight of the device is supported by the shell, which in turn is supported by the user's lower back and shoulders, the device can be used comfortably for extended periods of time.

The foregoing and other features and advantages of the invention are described in the attached specification and claims, and are illustrated in the accompanying drawings.

DESCRIPTION OF THE PREFERRED EMBODIMENT

Figure 1:
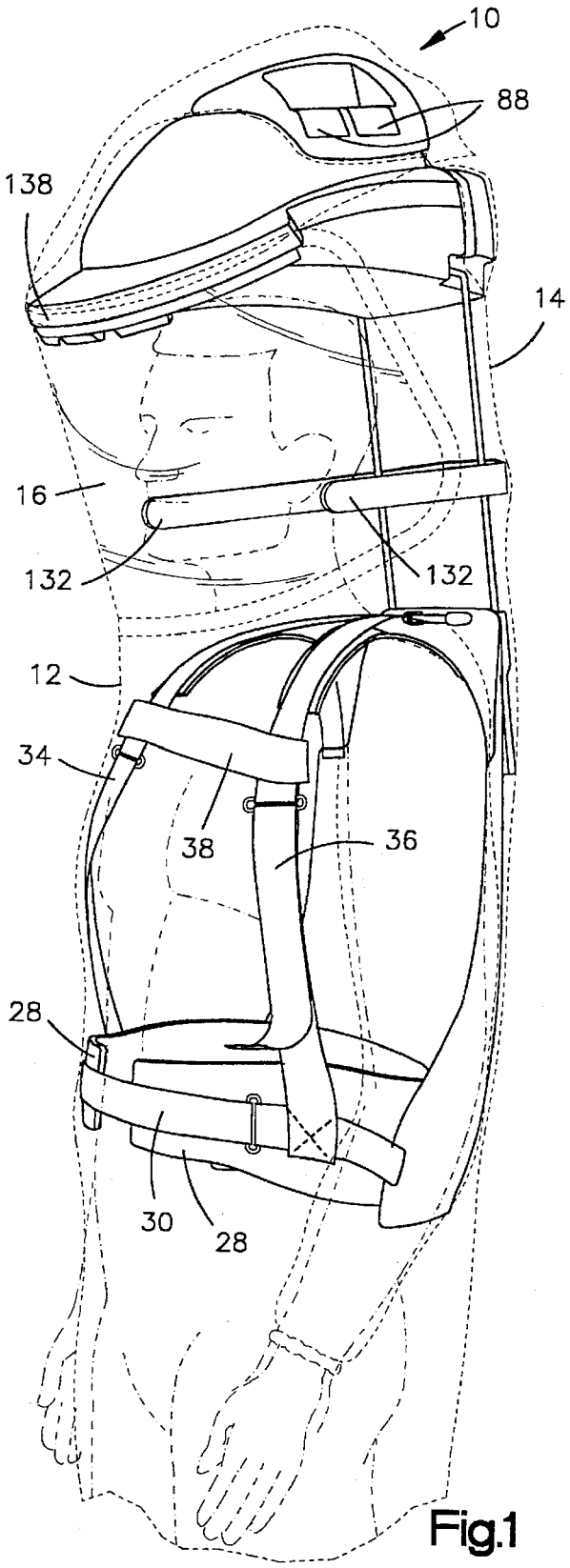
FIG. 1 is a perspective view of a surgical suit according to the invention.

Referring to FIGS. 1, 2, 5, and 6, a surgical suit according to the invention is indicated generally by the reference numeral 10. Although the suit 10 is intended especially for use in an operating room, it can be used in other places such as "clean rooms" where the user must be isolated for extended periods of time from the surrounding environment. The 10 includes a gown 12, a hood 14, and a visor 16 for the hood 14. The suit 10 includes a backpack 18 connected to the torso of the user. The suit 10 also includes a housing 20 spaced above the head of the user and a support means 22 that connects the backpack 18 and the housing 20 and maintains them in a desired fixed position relative to each other.

The Backpack 18

Referring now to FIGS. 2, 3, 5, and 6, the backpack 18 includes a shell 24 that conforms generally to the shape of the user's back. The shell 24 is made of a rigid plastics material such as ABS. A padded lower back cushion 26 is attached to the lower portion of the shell 24. A pair of wing portions, or hip pads 28 extend from the cushion 26 to be wrapped around the waist of the user. A belt 30 connects the opposing pads 28 and permits the cushion 26 and the pads 28 to be compressed by the user as much as desired.

An air-permeable spacer 32 is connected to opposite sides of the shell 24. The spacer 32 is in the form of a panel of nylon mesh. The spacer 32 ensures that the shell 24 will be spaced from the upper portions of the user's back.

The backpack 18 also includes a padded shoulder strap 34, a padded shoulder strap 36, and a tensioning strap 38 that connects the straps 34, 36. The belt 30, and the straps 34, 36, 38 each include a ring through which an end portion of the strap is passed. The belt 30 and the straps 34, 36, 38 include interlocking, pressure-responsive fasteners such as VELCRO fasteners that enable the belt 30 and the straps 34, 36, 38 to be conveniently adjusted to any desired length.

A power source in the form of a 12-volt battery 42 is disposed within an opening 44 included as part of the shell 24. A shelf 46 is provided in the shell 24 to support the battery 42. A belt 48 extends across the opening 44 in order to hold the battery 42 in place. As with the belt 30 and the straps 34, 36, 38, the belt 48 includes interlocking, pressure-responsive fasteners that enable the belt to be loosened quickly and tightened quickly. The use of an adjustable belt 48 enables the battery to be replaced quickly, when necessary.

A rectangular housing 50 projects rearwardly from the shell 24 at approximately the mid-point of the shell 24. The housing 50 defines a duct 52. A fan 54 is disposed in the duct 52. Due to the shape of the shell 24 and the presence of the spacer 32, the fan 54 and the duct 52 are spaced from the user's back a distance sufficient to permit air to flow in the space between the user's back and the inner surfaces of the shell

The Housing 20

Figure 4:
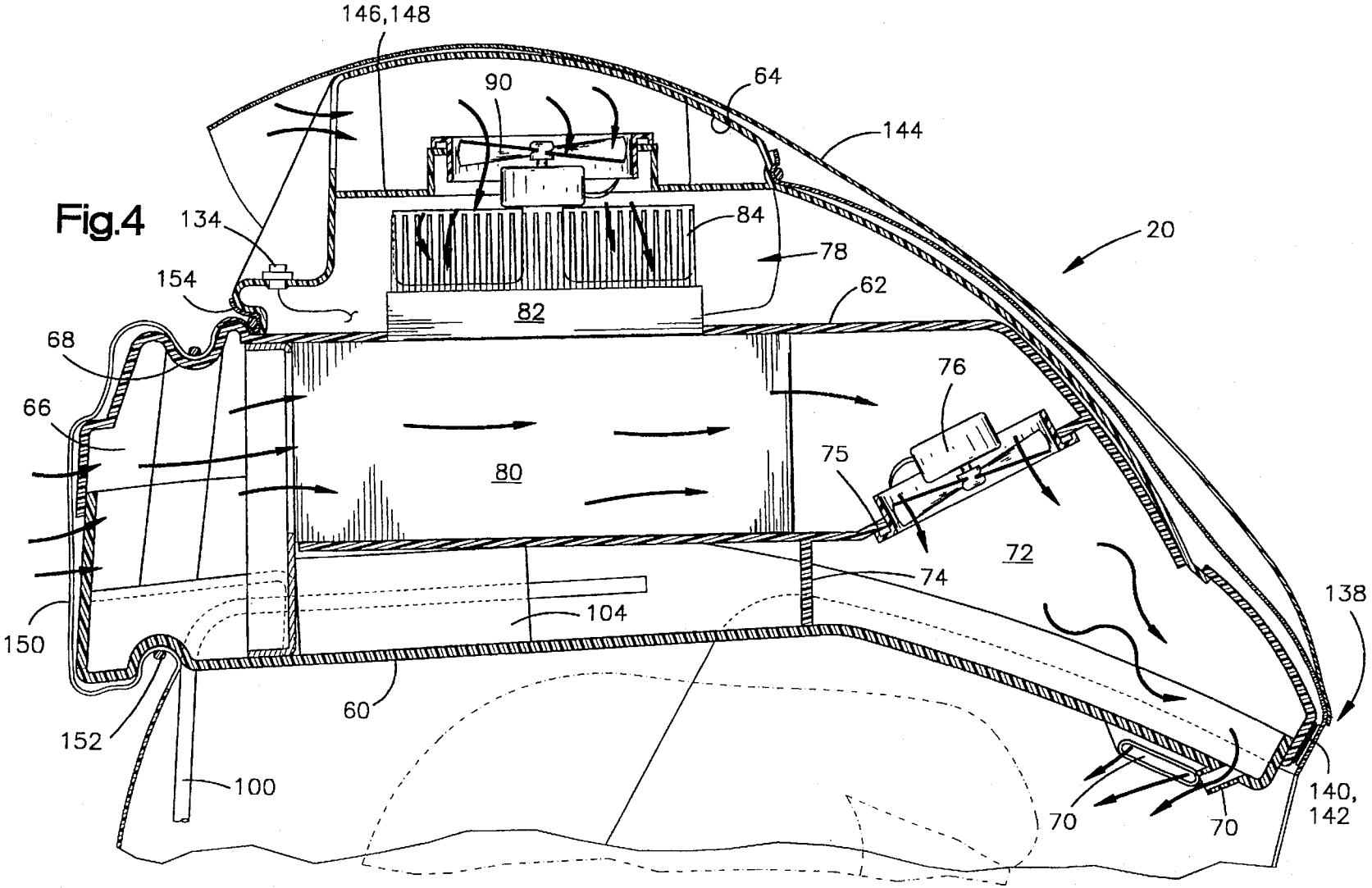
FIG. 4 is an enlarged cross-sectional view of the housing according to the invention, showing a TEM installed therein.
Figure 6:
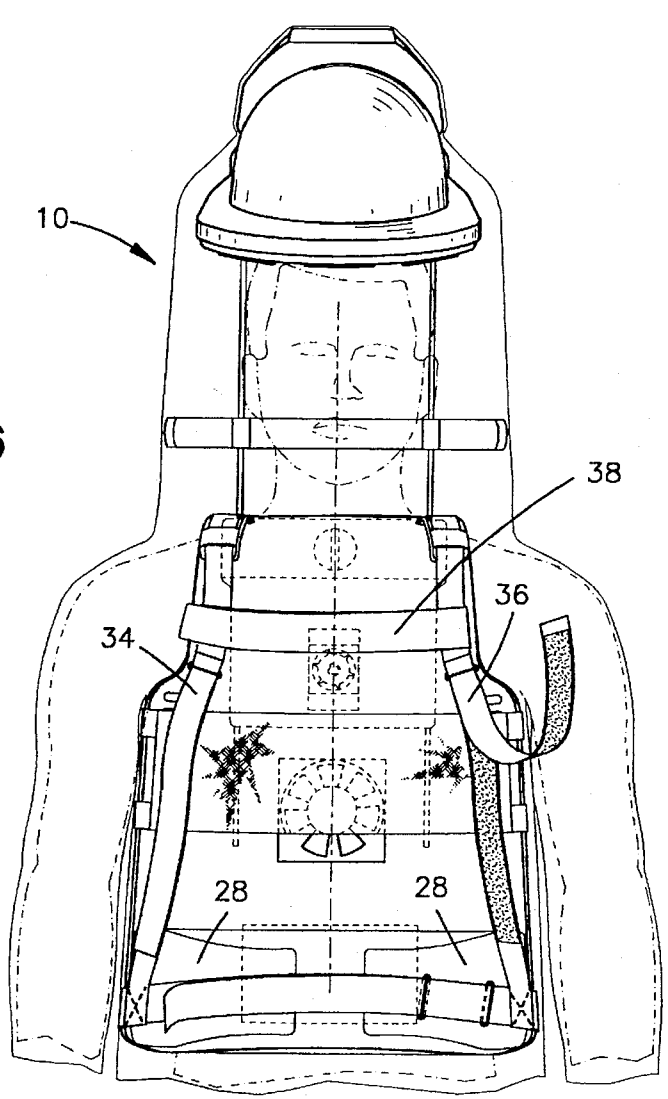
FIG. 6 is a front elevational view of the invention.

Referring particularly to FIG. 4, the housing 20 includes a lower formation 60 and an upper formation 62. A cover 64 is attached to the upper formation 62. The formations 60, 62 interlock to define an intake duct 66. A circumferential groove 68 is formed about the periphery of the intake duct 66. A plurality of discharge vents 70 are disposed about the lower front portion of the formation 60. The vents 70 are angled slightly rearwardly in order to discharge air toward the user's face. The forward portion of the formation 60, 62 includes a plenum 72. The plenum 72 is defined, in part, by a vertical wall 74 and an inclined wall 75. A fan 76 is mounted in an opening formed in the wall 75. As will be apparent from an examination of FIG. 4, activation of the fan will cause air to be drawn into the intake duct 66 where it will be pressurized in the plenum 72 for discharge through the vents 70.

Figure 5:
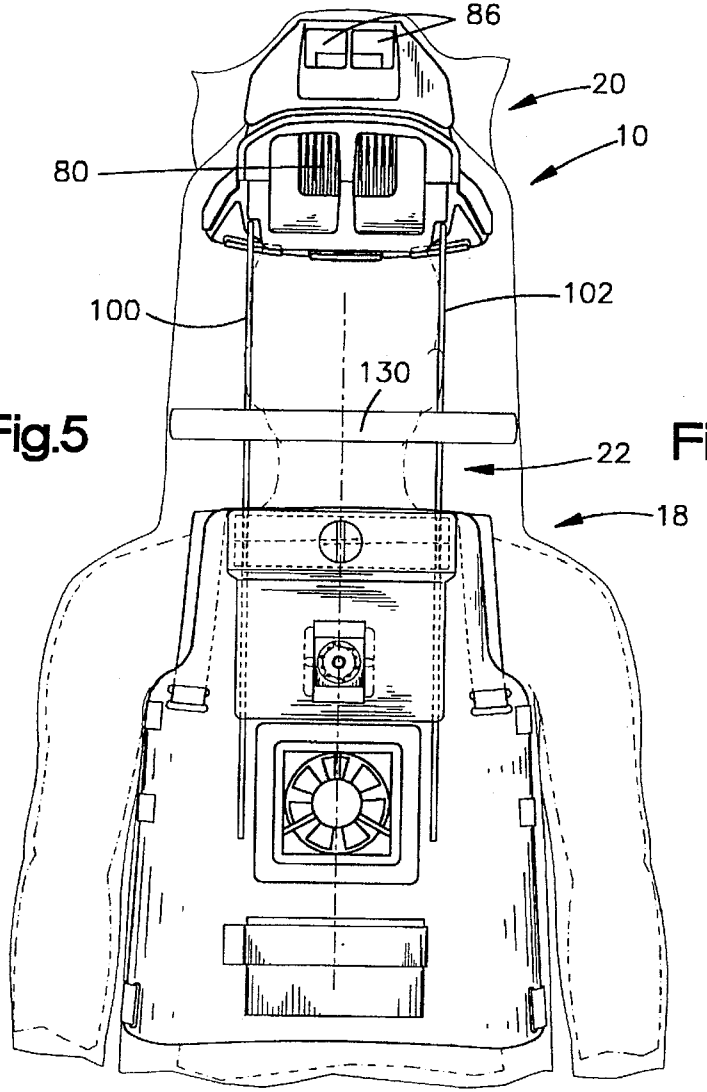
FIG. 5 is a rear elevational view of the invention.

For those instances where air-conditioning is desired, a thermoelectric heat pump 78, also referred to as a thermoelectric module (TEM) is disposed within the housing 20. The TEM 78 includes a plurality of large, metal, parallel heat abstraction plates 80 that are disposed in the duct 66. A TEM chip 82 is disposed in an opening formed in the upper formation 62. An acceptable TEM chip 82 is manufactured by Melcor, Model No. CP 1.4-127-10L. A plurality of parallel, metal heat dissipating plates 84 are disposed outside the upper formation 62 and underneath the cover 64. As can be seen in FIG. 5, the heat abstraction plates 80 are oriented in a direction facing from front to rear. As can be seen in FIG. 4, the heat dissipating plates 84 are aligned in a direction facing from side-to-side. Reference is made to the patent to Apisdorf, U.S. Pat. No. 5,193,347, for a teaching of a suitable TEM 78 and its manner of construction and operation, including circuitry, airflow rates, and temperature-reducing performance.

A pair of intake openings 86 are formed in the upper, rear portion of the cover 64. A pair of outlet openings 88 are disposed on either side of the upper portion of the cover 64. A fan 90 is disposed in the cover 6∝immediately above the heat dissipating plates 84. A foam insulation blanket (not shown) is disposed atop the upper formation 62 and underneath the cover 64. The insulation blanket assists in maintaining a large temperature difference between air flowing through the intake duct 66 and air flowing underneath the cover 64.

The Support Means 22

Portions of the support means 22 can be seen in FIGS. 2, 3, and 5–11. The support means 22 includes a vertically extending support rod 100 disposed on the right side of the user's spine, and a vertically extending support rod 102 disposed on the left side of the user's spine. The support rods 100, 102 are aligned generally parallel with each other and connect the backpack 18 and the housing 20. The upper portions of the support rods 100, 102 extend forwardly and are fitted into receptacles 104 included as part of the lower formation 60. The rods 100, 102 are rigidly secured within the receptacles 104 so that relative motion therebetween is not possible.

It is possible for only one support rod to be used, provided that the support rod is strong enough. It also is possible for the cross-section of the support rod to be something other than round, for example, square or triangular or that of an H-beam or an I-beam.

A generally rectangular bracket 106 is pivotally connected to the shell 24 by means of a hinge pin 108 that extends through opposed tabs 109. A block of flexible material 110 is disposed within the upper portion of the bracket 106 and includes a pair of slots 111 through which the support rods 100, 102 extend. A control knob 112 is disposed on the outside of the bracket 106. A pair of actuator links 114 are connected to the control knob 112 and extend to opposite sides of the block 110. As will be apparent from an examination of FIGS. 10 and 11, when the control knob 112 is turned to a clockwise position, the links 114 will cause the slots 111 to be tightened, thereby compressing the rods 100, 102 preventing their vertical movement. Upon turning the control knob 112 counterclockwise, the links 114 will release the force applied to the slots 111, thereby permitting the rods 100, 102 to be moved vertically.

Figure 7:
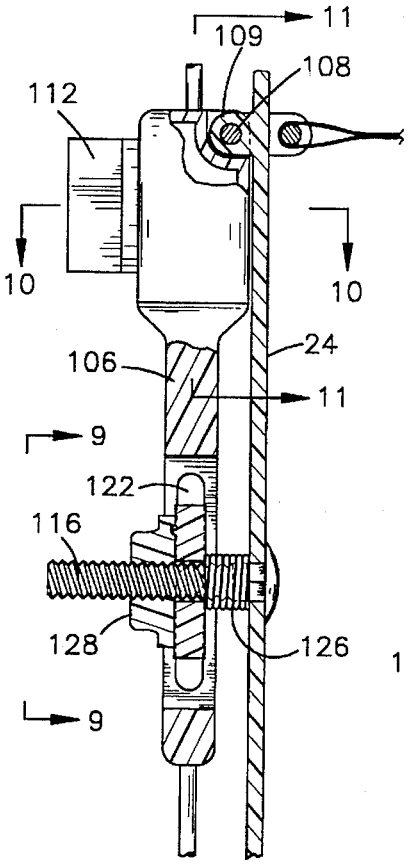
FIG. 7 is an enlarged cross-sectional view of an adjustable bracket included as part of the support means, showing the bracket in a position corresponding to a forward position of the housing.
Figure 8:
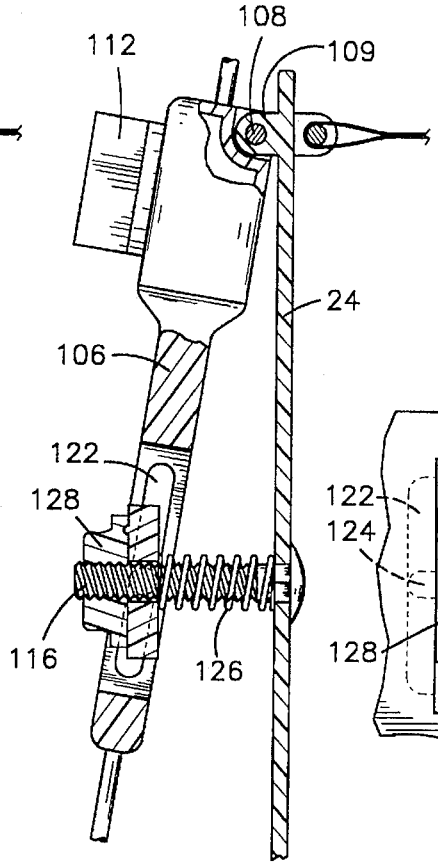
FIG. 8 is a view similar to FIG. 7 showing the bracket in a position corresponding to a rearward position of the housing.
Figure 9:
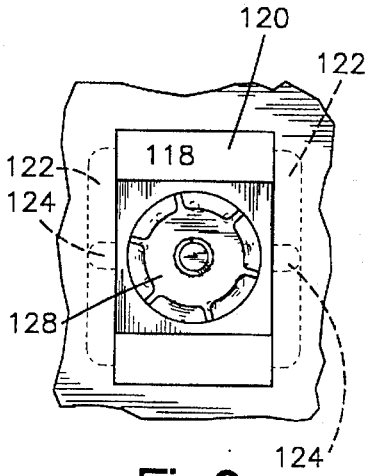
FIG.9 is an enlarged view of a portion of the bracket taken along a plane indicated by line 9—9 in FIG. 7.
Figure 10:
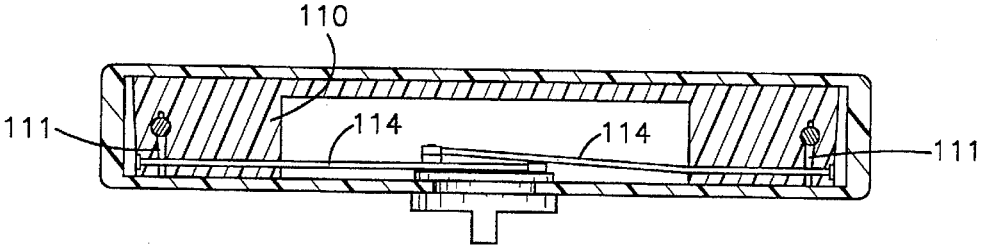
FIG. 10 is a cross-sectional view taken along a plane indicated by line 10—10 in FIG. 7 showing the mechanism by which support rods are adjusted vertically.
Figure 11:
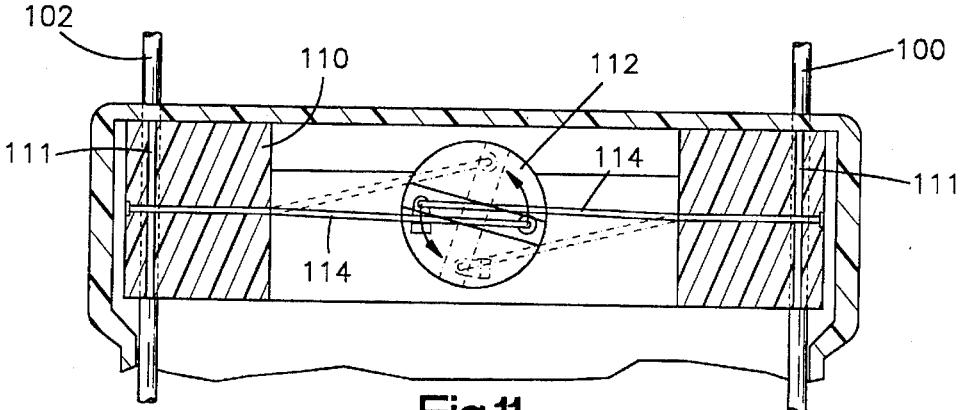
FIG. 11 is a cross-sectional view taken along a plane indicated by line 11—11 in FIG. 7 showing another view of the support rod adjustment mechanism.

Referring particularly to FIGS. 7–9, the backpack 18 includes a mechanism to permit the bracket 106 to be adjusted pivotally about the hinge pin 108. The adjustment mechanism includes a threaded bolt 116 projecting rearwardly from the shell 24. The bolt 116 extends through an opening formed in a plate 118. The plate 118 is disposed in a vertically extending slot 120 formed in the bracket 106. A pair of races 122 are formed on opposite sides of the slot 120 and receive pins 124 projecting from opposite sides of the plate 118. A spring 126 is fitted over the bolt 116 intermediate the shell 24 and the bracket 106. An adjustment nut 128 is threaded about the bolt 116.

As is apparent from an examination of FIG. 7, when the nut 128 is tightened, the plate 118 will compress the spring 126 and the bracket 106, with the support rods 100, 102 connected thereto, will be moved to a position parallel to the shell 24. When the adjustment nut 128 is loosened, the spring 126 will push the plate 118 away from the shell 24, thereby causing the lower portion of the bracket 106 to be pivoted away from the shell 24. Because the spring 126 constantly biases the bracket 106 away from the shell 24, the bracket 106 will be maintained in a stable position relative to the shell 24.

A spacer 130 is connected to the rods 100, 102 at a location approximately midway between the upper portion of the bracket 106 and the lower portion of the housing 20. The spacer 130 includes a pair of projecting portions 132 that extend forwardly of the rods 100, 102 on either side of the user's head. The projecting portions 132 engage the inner surfaces of the hood 14 and the visor 16 in order to keep them properly spaced away from the user's face and to ensure that proper airflow can occur.

Electrical snap connectors (not shown) are attached to the outer surface of the shell 24. Electrical leads (not shown) connect the battery 42 to one of the electrical snap connectors. Extensible electrical leads (not shown) connect the snap connectors, and thus the battery 42, to the fans 50, 76, 90, and to the TEM chip 82. A slide switch 134 is mounted to the cover 64 and is connected to the electrical leads. The slide switch 134 and the electrical leads are wired in order to provide fans only operation, an air-conditioning with fans operation, and an off position. If desired, a potentiometer or similar device could be wired in the circuitry in order to provide a variable fan speed capability or a variable air-conditioning capability, or both.

The Gown 12 and the Hood 14

The forwardmost edge of the housing 20 is identified by the reference numeral 138. Opposed strips 140, 142 of interlocking, pressure-responsive fasteners such as VELCRO fasteners are attached to the front edge 138 and the upper, inner edge of the visor 16. The front edge 138 thus provides a locator surface to ensure that the hood 14 is correctly positioned relative to the housing 20. The interlocking fasteners 140, 142 also permit the hood 16 to be quickly and securely connected to the housing 20.

A generally rectangular flap 144 is included as part of the hood 14. Interlocking, pressure-responsive fasteners 146, 148 such as VELCRO fasteners are attached to the rear of the flap 144 and the upper, rear portion of the cover 64. The flap 144 drapes over the laterally extending outlet openings 88, but does not close off the intake opening 86. When the fan 90 is operated, air flowing outwardly through the openings 88 will cause the flap 144 to be lifted away from the openings 88.

Figure 3:
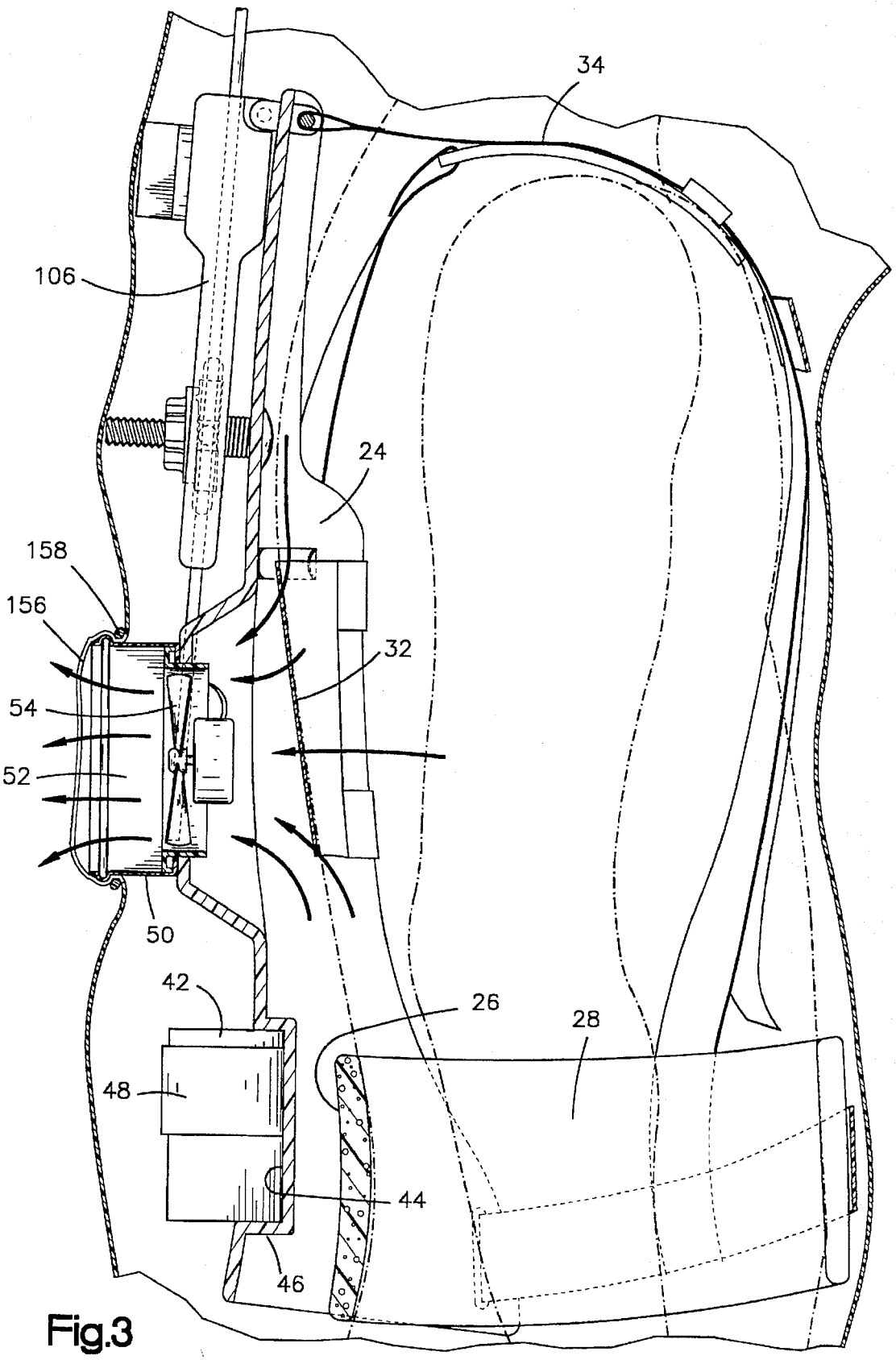
FIG. 3 is an enlarged side elevational view, partly in section, of a housing support means and an exhaust fan.

The rear portion of the hood 14 includes a rectangular filter section 150. The filter section is adapted to be secured about the intake duct 66 by means of a rubber band 152 fitted into the circumferential groove 68. Similarly, a rubber band 154 holds the upper portion of the hood 14 onto the cover 64 at a location beneath the openings 86, 88. Referring particularly to FIG. 3, a rectangular filter section 156 is included as part of the rear portion of the gown 12. The filter section 156 is fitted over the duct 52 and is held in place there by means of a rubber band 158.

The material used for the gown 12 and the hood 14 is commercially available from such companies as Stryker and DePuy. The material used for the filters 150, 156 likewise is commercially available. Regardless of the material selected for the filters 150, 156, it should have a filteration capacity of proximately 0.1 micron.

Operation

Figure 2:
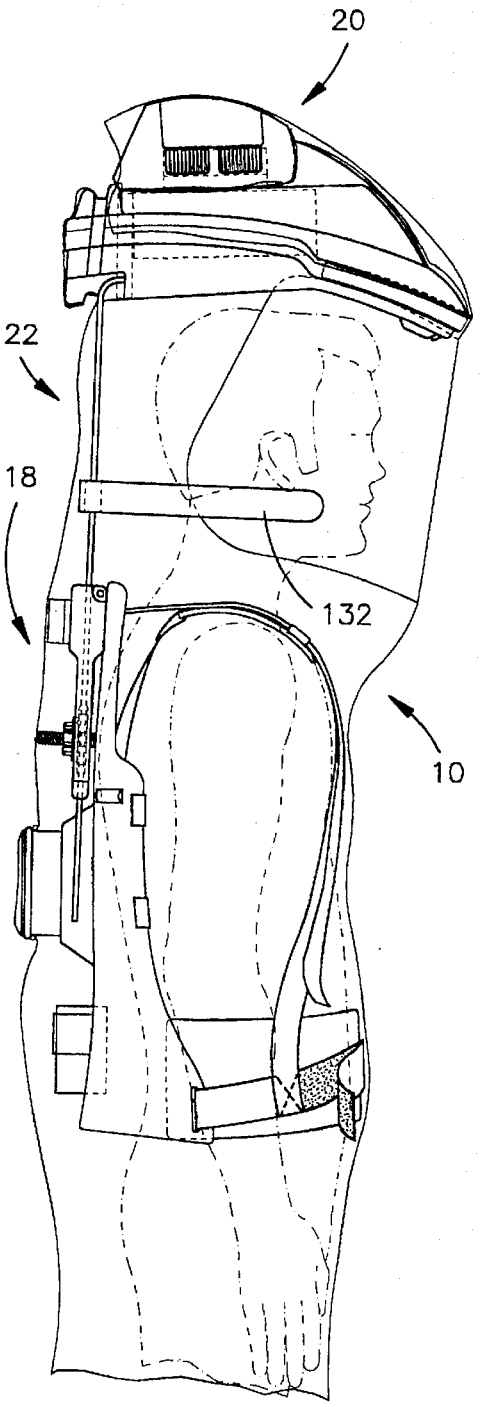
FIG. 2 is a side elevational view of the invention.

The suit 10 can be put on the user either with or without the housing 20 in place. In either case, the backpack 18 is positioned as shown in FIGS. 1 and 2 and the belt 30 is tightened. The shoulder straps 34, 36 are adjusted to a comfortable position, and the strap 38 is tightened to eliminate any slack in the straps 34, 36. After the support rods 100, 102 have been adjusted vertically by loosening and subsequently tightening the control knob 112, the lower formation 60 should be spaced comfortably above the head of the user, approximately one inch or so. The vertical position of the formation 60 should be adjusted so that no interference with the user's head is possible, while insuring that the vents 70 are positioned close to the user's face. After the housing 20 has been adjusted vertically, the nut 128 is rotated either clockwise or counterclockwise to pivot the bracket 106 about the pin 108. The bracket 106 should be pivoted as necessary to position the housing 20 in approximately a central position above the user's head.

The hood 14 is turned inside out so that the interlocking fasteners 140, 142 can be connected. The hood 14 then is positioned over the housing 20 where the rubber bands 152, 154 can secure the filter section 150 and the upper portion of the hood 14, respectively, to the housing 20. The flap 144 is positioned atop the cover 64 and the interlocking fasteners 146, 148 are connected.

A zipper (not shown) at the rear of the gown 12 is closed in order to secure the gown 12 about the user's body. The filter section 156 is fitted about the housing 50 and is held in place there by the rubber band 158. The slide switch 134 then can be moved to a position that provides a "fans only" operation or an air-conditioning operation, as described previously.

As will be apparent from an examination of FIGS. 1 and 2, the visor 16 is exceedingly large so that the user's vision is not impaired. The visor extends well behind the user's ears and beneath the user's chin.

A significant feature of the present invention is the ability to provide a sterile surgical suit while maintaining the greatest degree of comfort for the user. Unlike prior devices that have employed head-attached helmets, the present invention completely eliminates any discomfort to the user by avoiding any contact with the airflow apparatus and the user's head. It has been found that by supporting the weight of the apparatus entirely with a backpack, and particularly a backpack that has a padded portion that engages the user's lumbar region and which employs padded shoulder straps, the device can be worn for extended periods of time without discomfort.

Another important advantage of the present invention is the manner in which air is flowed through the hood 14 and the gown 12. The projecting portions 132 of the spacer 130 make certain that the hood 14 and the visor 16 always are spaced away from the user's head and neck. Because the hood 14 and the gown 12 are loosely fitted in the region of the user's shoulders, air being discharged through the vents 70 can flow downwardly readily past the user's face and head and around the user's upper body. As can be seen from an examination of FIG. 3, the spacer 32 spaces the shell 24 from the user's back so that a path is readily available for air to flow between the shell 24 and the user's back, thereby cooling the user's upper torso effectively.

The present invention provides an "isolated" system in the sense that ambient air brought into the suit 10 is drawn through a filter disposed upstream of the intake duct 66. After air has been passed over the user's face and upper body, it is discharged through a filter disposed downstream of the duct 52. Accordingly, the head and upper body of the user are completely isolated from the ambient atmosphere.

The present invention has been found to be exceedingly effective in reducing the temperature of the ambient air. For example, at an ambient temperature of 73°, the temperature immediately upstream of the fan was measured at 58.8° F., the temperature immediately downstream of the fan was measured at 60.9° F., and the output temperature from the duct 70 was measured at 63.0° F. The flow rate averaged about 4.49 SCFM. A temperature drop of approximately 10° F. from ambient, coupled with airflow on the order of 3–15 SCFM past the user's face and upper body, is a significant factor in providing a comfortable environment for the user. It is expected that if the TEM 78 is operated at full power, temperature drops on the order of 16° F. and greater can be attained. For continuous operation at lower power levels, it is expected that temperature drops on the order of 8° F. can be attained.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A surgical suit having the capability to provide a flow of air over a user's head and upper body, comprising:

a hood fitted loosely about the user's head, the hood including a transparent visor disposed in front of the user's face;

a gown fitted loosely about the user's body, the gown being connected to the hood to provide a substantially integral connection therebetween;

a housing spaced above the user's head and underneath the hood, the housing in use carrying a substantial portion of the weight of the hood and visor, the housing being in fluid communication with the atmosphere outside the hood by means of an intake duct, the housing including a discharge vent that discharges air downwardly within the hood;

a first fan disposed within the housing to provide a flow of air through the intake duct and the discharge vent;

support means connected to the user's torso for supporting the housing in spaced relationship above the user's head so that the user is able to move the user's head without restriction;

a power source carried by the support means, the power source being electrically connected to the fan; and a fan control electrically connected between the power source and the fan, the fan control permitting the fan to be activated or de-activated whenever desired.

2. The surgical suit of claim 1, wherein the fan control includes electrical circuitry for varying the speed of the fan.

3. The surgical suit of claim 1, wherein more than one vent is provided, and wherein the vents are positioned and oriented such that airflow discharged therefrom is directed toward the user's face.

4. The surgical suit of claim 1, wherein the housing includes a plenum into which air is blown by the fan, and from which air is discharged through the vent.

5. The surgical suit of claim 1, further comprising:

a thermoelectric module (TEM) carried by the housing, the TEM having a heat dissipation side and a heat abstraction side, the heat abstraction side being disposed within the intake duct, the heat abstraction side being in heat-conducting association with air flowing through the intake duct;

an electrical connection between the power source and the TEM; and control circuitry included as part of the fan control to activate both the fan and the TEM whenever desired.

6. The surgical suit of claim 5, wherein the heat dissipation side of the TEM is disposed outside the housing, and further comprising:

a cover fitted to the housing, the heat dissipation side of the TEM being disposed underneath the cover, the cover including an inlet opening through which ambient air can be drawn and an outlet opening through which heated air can be exhausted; and a second fan disposed underneath the cover, the second fan being electrically connected to the power source and the fan control, the second fan upon activation causing air to be drawn into the inlet opening and exhausted through the outlet opening.

7. The surgical suit of claim 1, wherein the support means includes:

a shell that conforms generally to the shape of the user's back; and a support rod connected to the shell and extending generally vertically therefrom, the housing being connected to the support rod.

8. The surgical suit of claim 7, wherein two support rods are provided, the first support rod being disposed on one side of the user's spine and the second support rod being disposed on the other side of the user's spine, the first and second support rods being disposed generally parallel to each other.

9. The surgical suit of claim 7, further comprising a bracket connected to the shell, the support rod being connected to the bracket, the bracket including an adjustment mechanism that permits the support rod to be adjusted vertically as well as to be pivoted about a horizontal axis.

10. The surgical suit of claim 9, wherein the vertical adjustment is provided by:

a flexible clamp through which the rod extends;

an actuator arm connected to the clamp; and a control knob connected to the actuator arm, the control knob being movable between a locked position in which the clamp engages the rod tightly and an unlocked position in which the clamp engages the rod loosely.

11. The surgical suit of claim 9, wherein the pivoting adjustment is provided by:

a threaded bolt connected to the shell and extending through an opening in the bracket;

a spring disposed between the bracket and the shell to bias the bracket away from the shell; and a nut threadedly fitted to the bolt, the nut engaging the bracket and compressing the spring.

12. The surgical suit of claim 1, wherein the support means includes:

a padded belt adapted to be secured about the user's waist;

shoulder straps extending over the user's shoulders and connected to the front portion of the belt, the shoulder straps being adjustable relative to the belt; and a laterally extending, adjustable-length tensioning strap connecting the shoulder straps.

13. The surgical suit of claim 1, further comprising a fan carried by the support means and disposed underneath the gown, the fan being electrically connected to the power source, the fan in use drawing air from within the gown and hood and discharging it outside the gown.

14. The surgical suit of claim 13, further comprising an air-permeable spacer connected to opposite sides of the shell intermediate the shell and the user's back in the region of the fan, the spacer ensuring that the shell will be spaced sufficiently from the user's back to enable air to flow therebetween at all times.

15. The surgical suit of claim 14, wherein the spacer is a panel of nylon mesh.

16. The surgical suit of claim 1, further comprising:

a locator surface defined by the forwardmost part of the housing; and interlocking, pressure-responsive fasteners attached to the inner portion of the hood in the region of the visor and to the locator surface, the fasteners permitting the hood to be removably attached to the housing in a desired position relative to the housing.

17. The surgical suit of claim 1, wherein the gown and hood are sufficiently loose relative to the use's neck and shoulders that air can flow downwardly around the user's head to around the user's torso.

18. The surgical suit of 1, further comprising a first panel of filter material included as part of the rear portion of the hood, the first panel in use being tightly fitted about the intake duct.

19. The surgical suit of claim 1, further comprising:

a duct-defining fan support housing extending from the support means in the region of the user's torso, a second fan being disposed within the housing; and a second panel of filter material included as part of the portion of the gown, the second panel in use being tightly fitted about the fan support housing.

20. A surgical suit having the capability to provide an air-conditioned flow of air over a user's head and upper body, comprising, a hood fitted loosely about the user's head, the hood including a transparent visor disposed in front of the user's face;

a gown fitted loosely about the user's body, the gown being connected to the hood to provide a substantially integral connection therewith;

a housing spaced above the user's head and underneath the hood, the housing in use carrying a substantial portion of the weight of the hood and visor, the housing being in fluid communication with the atmosphere outside the hood by means of an intake duct, the housing including a discharge vent that discharges air downwardly within the hood;

a first fan disposed within the housing to provide a flow of air through the intake duct and the discharge vent;

a thermoelectric module (TEM) carried the housing, the TEM having a heat dissipation side and a heat abstraction side, the heat abstraction side being disposed within the intake duct, the heat abstraction side being in heat conducting association with air flowing through the intake duct;

a cover fitted to the housing, the heat dissipation side of the TEM being disposed outside the housing and underneath the cover, the cover including an inlet opening through which ambient air can be drawn and an outlet opening through which heated air can be exhausted;

a second fan disposed underneath the cover, the second fan upon activation causing air to be drawn into the inlet opening and exhausted through the outlet opening;

support means connected to the user's torso for supporting the housing in spaced relationship above the user's head so that the user is able to move the user's head without restriction;

a power source carried by the support means; the power source being electrically connected to the first fan, the second fan, and the TEM; and a fan control electrically connected between the power source and the first fan, the second fan, and the TEM, the fan control permitting the first and second fans or the first and second fans and the TEM to be selectively activated or deactivated whenever desired.

* * * * *

UNITED STATES PATENT AND TRADEMARK OFFICE

CERTIFICATE OF CORRECTION

PATENT NO : 5,655,374

DATED : August 12, 1997

INVENTOR(S) : Albert N. Santilli, et al.

It is certified that error appears in the above-identified patent and that said Letters Patent is hereby corrected as shown below:

Column 4, line 18, after "shell" insert --24.--.

Column 4, line 57, delete "6∝" and insert --64--.

Column 6, line 47, delete "proximately" and insert --approximately--.

Column 10, line 38, after "carried" insert --by--.

Signed and Sealed this

Tenth Day of November 1998

Bruce Lehman

*Attest:*

BRUCE LEHMAN

*Attesting Officer*

*Commissioner of Patents and Trademarks*